US010384484B2

(12) United States Patent
Guzzo et al.

(10) Patent No.: US 10,384,484 B2
(45) **Date of Patent: *Aug. 20, 2019**

(54) REVEAL SUBSTRATE AND METHODS OF USING THE SAME

(71) Applicant: VIRTUAL GRAPHICS, LLC, Easton, PA (US)

(72) Inventors: John V. Guzzo, Easton, PA (US); Daniel F. Peters, Hamilton, OH (US); Ricky L. Helton, Mason, OH (US)

(73) Assignee: VIRTUAL GRAPHICS, LLC, Easton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/575,845

(22) PCT Filed: May 26, 2017

(86) PCT No.: PCT/US2017/034695

§ 371 (c)(1),
(2) Date: Nov. 21, 2017

(87) PCT Pub. No.: WO2017/205749

PCT Pub. Date: Nov. 30, 2017

(65) Prior Publication Data

US 2019/0070882 A1 Mar. 7, 2019

Related U.S. Application Data

(63) Continuation of application No. 15/165,688, filed on May 26, 2016, now Pat. No. 9,757,968.

(51) Int. Cl.
*B41M 5/36* (2006.01)
*B41M 5/124* (2006.01)

(52) U.S. Cl.
CPC ..... *B41M 5/124* (2013.01); *B41M 5/36* (2013.01)

(58) Field of Classification Search
CPC ..... B41M 5/124; B41M 5/36
See application file for complete search history.

(56) References Cited

U.S. PATENT DOCUMENTS 8,054,323 B2 11/2011 Peters et al.
9,757,968 B1 9/2017 Guzzo et al.
(Continued)

FOREIGN PATENT DOCUMENTS

WO 2015148619 A1 10/2015
WO WO 2017/223198 * 12/2017 ..... B41M 5/36
WO WO 2018/148027 * 8/2018 ..... B29C 64/118

OTHER PUBLICATIONS

International Search Report for corresponding application PCT/US2017/034695 dated Aug. 25, 2017.
(Continued)

*Primary Examiner* — Huan H Tran
(74) *Attorney, Agent, or Firm* — Norris McLaughlin, P.A.

(57) ABSTRACT

Disclosed is a reveal substrate comprising: a) a top substrate layer comprising an opaque polymer sensitive to application of heat or pressure, and becoming transparent upon being heated to a predetermined temperature or subjected to a predetermined pressure, and b) a bottom substrate layer having one or more colored areas on a top surface thereof, disposed such that said one or more colored areas are obscured by the opaque polymer prior to being heated to the predetermined temperature or subjected to the predetermined pressure, and are revealed subsequent thereto, wherein: each of the one or more colored areas comprises at least two different colors, and comprises a two-dimensional matrix formed by a plurality of color blocks, each one of the plurality of color blocks having only one color, and the color blocks are arranged to have a repeating color pattern. Alternatively the top substrate layer comprises an opaque material which can be induced by, e.g., UV, to become
(Continued)

transparent. Further the top substrate layer can comprise a transparent material which can be induced by, e.g., UV, to become opaque. Methods of using the disclosed substrates are also disclosed.

18 Claims, 6 Drawing Sheets

(56) References Cited

U.S. PATENT DOCUMENTS

| | | | |
|---|---|---|---|
| 2008/0218539 | A1 | 9/2008 | Hill et al. |
| 2010/0245524 | A1 | 9/2010 | Peters et al. |
| 2010/0247223 | A1 | 9/2010 | Ribi |
| 2011/0090298 | A1 | 4/2011 | Bombay et al. |
| 2011/0205326 | A1 | 8/2011 | Roth et al. |
| 2013/0302550 | A1 | 11/2013 | Tang et al. |

OTHER PUBLICATIONS

Written Opinion of the International Searching Authority for corresponding application PCT/US2017/034695 dated Aug. 25, 2017.
International Preliminary Report on Patentability in corresponding application PCT/US2017/034695 dated Nov. 27, 2018.

* cited by examiner

--Prior Art--

REVEAL SUBSTRATE AND METHODS OF USING THE SAME

This application is a § 371 U.S. National stage of PCT International Patent Application No. PCT/US2017/053947, filed May 26, 2017, which claims priority of U.S. application Ser. No. 15/165,688, filed May 26, 2016, the disclosures of each of which patent applications are incorporated herein by reference.

FIELD OF THE INVENTION

The present invention improves upon the printing substrates and methods described in U.S. Pat. No. 8,054,323 by the same inventors. Specifically, the present invention provides a reveal substrate having the top substrate layer made from the opaque polymer as described in the '323 patent, and a bottom substrate layer having one or more colored areas, each of which comprises a two-dimensional matrix formed by a plurality of single-colored color blocks, which are arranged to have a repeating color pattern.

DISCUSSION AND COMPARISON WITH RELEVANT PRIOR ART

Heat-sensitive material is common in the field of adhesive-backed heat-sensitive labels and other thermally sensitive paper stock used in printers and facsimile equipment. The labels are useful in packaging goods which, in transit, storage, or display, may be exposed to diverse solvents, and may be used on meat, produce, or articles of manufacture commonly exposed to water or other solvents. A bar code and/or alphanumeric information may be formed on such labels at the point of sale by imaging the label with a thermal print head.

Previously, thermal printing typically employs a substrate which is coated with a multitude of microcapsules or other separate heat sensitive material which renders a color upon being heated. For example, microcapsules are heat sensitive in that the microcapsule is opened to reveal the color composition contained therein by way of heat application. Such media of the type currently used are often exposed to unwanted ultraviolet rays, water, fats, oils, and other solvents which can have an adverse effect on the thermal image, increase background discoloration, and in some cases, destroy the machine readability of the imprinted image, such as bar codes. Nevertheless, this type of substrate is typically used in the thermal fax paper or thermal receipt paper dispensed from store registers or gas stations, for example. This type of paper provides an economical solution for such applications where a roll of thermal printable substrate is desired.

In U.S. Pat. No. 8,054,323, the inventors of the present invention describe improved substrates and methods of using the same, which reduce costs and address the problem associated with the conventional technology, such as sensitivity to ultraviolet light. The reveal substrate according to the '323 patent has an opaque polymer sensitive to application of one of heat and pressure which upon one of being heated to a predetermined temperature or subjected to a predetermined pressure causes the opaque polymer to become transparent, and a color material disposed in relation to the substrate in a manner to be obscured by the opaque polymer prior to one of the application of the predetermined heat or the predetermined pressure and is revealed subsequent thereto. The disclosure of U.S. Pat. No. 8,054,323 in its entirety is hereby incorporated by reference into this application.

The substrate and associated method of the present invention improve upon that described in the '323 patent. Specifically, the present invention provides a reveal substrate having the top substrate layer made from the opaque polymer as described in the '323 patent, and a bottom substrate layer having one or more colored areas, each of which comprises a two-dimensional matrix formed by a plurality of single-colored color blocks, which are arranged to have a repeating color pattern.

Aspects of the present invention will be understood with reference to the following specification and drawings.

SUMMARY OF THE INVENTION

Disclosed is a reveal substrate comprising: a) a top substrate layer comprising an opaque polymer sensitive to application of heat or pressure, said opaque polymer becoming transparent upon being heated to a predetermined temperature or subjected to a predetermined pressure, and b) a bottom substrate layer having one or more colored areas on a top surface thereof, said bottom substrate layer being disposed in a manner such that said one or more colored areas are obscured by the opaque polymer prior to being heated to the predetermined temperature or subjected to the predetermined pressure, and are revealed subsequent thereto, wherein: each of the one or more colored areas comprises at least two different colors, and each of the one or more colored areas comprises a two-dimensional matrix formed by a plurality of color blocks, each one of the plurality of color blocks having only one of the at least two different colors, and the plurality of color blocks are arranged to have a repeating color pattern. Alternatively the top substrate layer comprises an opaque material which can be induced by, e.g., UV, to become transparent. Further the top substrate layer can comprise a transparent material which can be induced by, e.g., UV, to become opaque. Methods of using the disclosed substrates are also disclosed.

BRIEF DESCRIPTION OF THE DRAWINGS

FIG. 4A shows a grid having lined-up borders formed by the plurality of color blocks, having a single print unit per color block. FIG. 4B shows a grid having a running bond pattern formed by the plurality of color blocks, having two print units per color block. Each capitalized letter "C", "M", "Y", "K" shown in FIGS. 4A and 4B represents a single print unit of the colors Cyan, Magenta, Yellow, and Key (black) in the CMYK color model.

DETAILED DESCRIPTION

The present invention relates to instruments and methods used in the field of printing. More particularly, the present invention is directed to new print substrates and methods of using the same.

Definitions

As used herein, and unless stated otherwise, each of the following terms shall have the definition set forth below.

As used herein, a "two-dimensional matrix" refers to any two-dimensional, and preferably repeating, pattern formed from a plurality of two-dimensional spaces, and can take the form of e.g., a conventional grid, a grid having a running bond pattern (where borders of the blocks forming the grid are off-set), a circular or rectangular grid. The two-dimensional spaces are preferably of uniform shape and/or size. The pattern can additionally include screen angles for, in particular, creating halftone images. Further, a "color block" as used herein is not limited to any specific shape, but can be any two dimensional shape, e.g., a square, rectangle circle or amorphous.

As used herein, "about" in the context of a numerical value or range means±10% of the numerical value or range recited or claimed. By any range disclosed herein, it is meant that all hundredth, tenth and integer unit amounts within the range are specifically disclosed as part of the invention. Accordingly, "about" a recited value specifically includes that recited value. For example, a range of about 100-150 mm refers to all measurements within the range of ±10% of 100 mm and 150 mm, including 100 mm and 150 mm.

As used herein, "substantially" in reference to an area, e.g., surface area, means 90% or more of said area.

Figure 1:
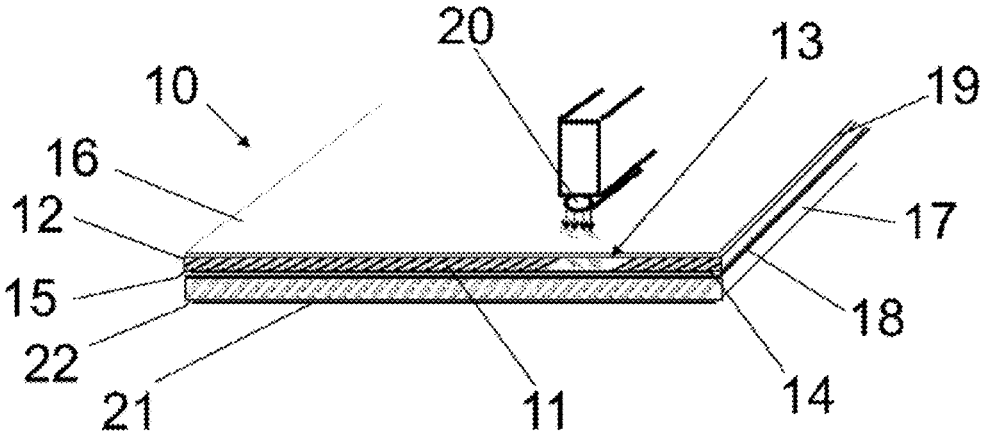
FIG. 1 shows a perspective view of a reveal substrate in accordance with the teaching of U.S. Pat. No. 8,054,323.

FIG. 1 shows a perspective view of a reveal substrate in accordance with the teachings of U.S. Pat. No. 8,054,323. Briefly, the '323 patent provides a thermal or pressure reveal substrate (10) which includes a thermally and/or pressure sensitive substrate (12) having an opacifying material (11) which upon being heated to a certain temperature or subjected to certain pressure becomes transparent to reveal color material (14) underneath. When viewed from a second side surface (16) prior to any thermal or pressure application, the color material (14) is not viewable. Upon applying a predetermined heat via, e.g., a print head (20), the opacifying material (11) is rendered non-opaque and the region (13) to which such print head (20) is applied becomes transparent, thus revealing the color material (14) underneath. The thermally and/or pressure sensitive substrate (12) can include another coating (19) such as varnish as a protective element (over print lacquer) to protect the color material (11). In the case of forming labels, an adhesive material (18) can be applied.

The substrate and associated methods described herein improve upon that described in the '323 patent by providing an improved and more versatile color material (14) layer, which can provide an infinite combination of colors and shading to form full-color or gray-scale images.

Specifically, a reveal substrate according to the present invention has a top substrate layer made from the opaque polymer as described in the '323 patent, and a bottom substrate layer having one or more different colored areas. The bottom substrate layer comprises at least 2 different colors, preferably at least 3, 4 or more different colors. The different colored areas each comprises a two-dimensional matrix formed by a plurality of color blocks, each one of the plurality of color blocks having only one color, and the plurality of color blocks are arranged to have a repeating color pattern. The colors of the color blocks are preferably colors of known color models including, e.g., the CMYK color model or the RGB model.

In use according to one embodiment of the invention as described herein, a thermal print head can be programmed to heat only a selected section of the top substrate layer which corresponds in position to selected color blocks or portions thereof, causing only the desired colors at the desired locations to be revealed. As a person having ordinary skill in the art would appreciate, a multitude of colors can be formed by using the basic colors of the CMYK model. Thus, the print heat can be programmed to reveal an overall image that is not limited to a single block color, but rather can be a picture or a graphic, having a range of colors, color intensities and designs formed by the careful selection of the combination of the CMYK colors. The substrate of the present invention allows dithering technique to be applied to thermal printing.

As will be appreciated by a person having ordinary skill in the art, the color blocks and/or print units within said color blocks should be sufficiently small in size such that a human being viewing the substrate from a distance will more readily perceive an overall imaged formed, rather than the individual selected color blocks (or portions thereof). In a specific embodiment, the color block is the same size, or substantially the same size, as the smallest dot (print unit) that can be printed by a print head. In addition, the color block can be about 2 times, 3 times, 4 times or more, of the size of said smallest dot. The size of the smallest dot that can be fired by a print head depends on the quality of the printer. Conventional printers used in the art have print heads that can print between about 200 to 300 dots per inch on the lower end, and up to about 600 dots per inch on the higher end. In an embodiment, said smallest dot can have areas ranging from 0.11 $mm^2$ to 0.1 $mm^2$. Accordingly, the substrates of the present invention provide for greater range of customization and graphic capabilities, as compared to that described in the '323 patent. For example, the substrates of the present invention allows for thermal printing of halftone images, which was not possible on prior art substrates. Further, the substrates of the present invention allow for thermal printing of images having embedded security features, such as including in the overall image one or a series of hidden color code or signature, similar to security features presently used in digital or laser printing.

With reference to FIGS. 3-6, exemplary reveal substrates and methods according to the present invention are described below. These examples are set forth to aid in an understanding of the present invention but are not intended to, and should not be construed to, limit in any way the claims which follow thereafter. Further, in these figures, like or corresponding elements presented in different drawing figures are identified using the same reference numeral.

One embodiment of the present invention provides a reveal substrate (100) comprising: a) a top substrate layer (101) comprising an opaque polymer sensitive to application of heat or pressure, said opaque polymer becoming transparent upon being heated to a predetermined temperature or subjected to a predetermined pressure, and b) a bottom substrate layer (102) having one or more colored areas (103) on a top surface thereof (104), said bottom substrate layer (102) being disposed in a manner such that said one or more colored areas (103) are obscured by the opaque polymer in the top substrate layer (101) prior to being heated to the predetermined temperature or subjected to the predetermined pressure, and are revealed subsequent thereto, wherein: each of the one or more colored areas (103) comprises at least two different colors, and each of the one or more colored areas (103) comprises a two-dimensional matrix (105) formed by a plurality of color blocks (106), each one of the plurality of color blocks having only one of the at least two different colors, and the plurality of color blocks are arranged to have a repeating color pattern.

Figure 2:
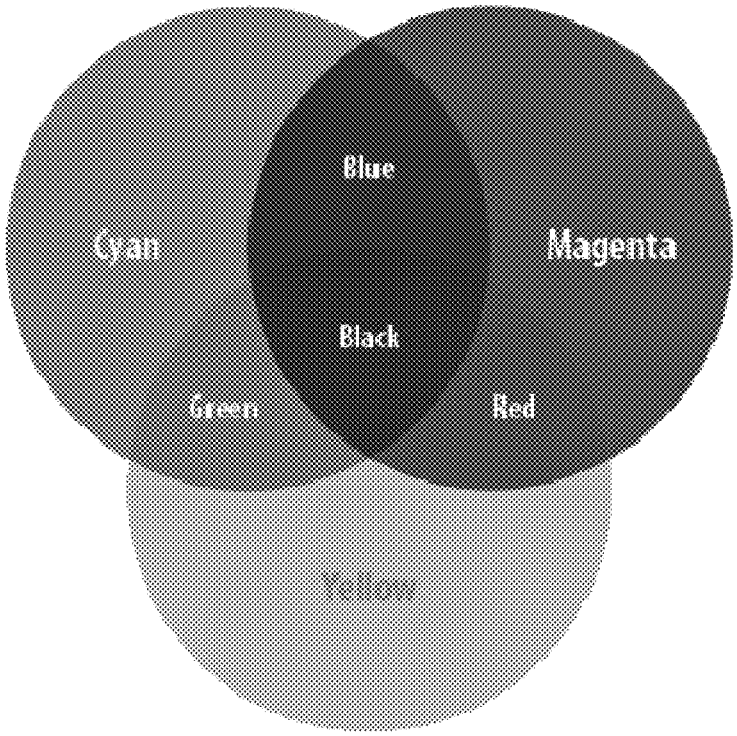
FIG. 2 shows colors of the subtractive CMYK color model.
Figure 3A:
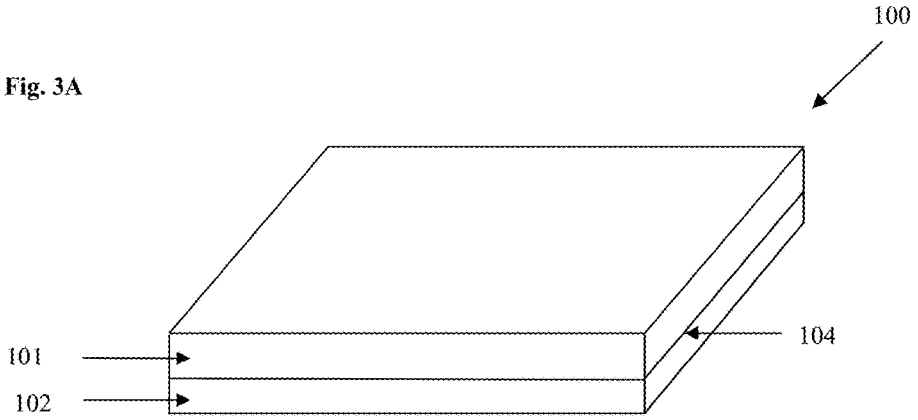
FIG. 3A shows a perspective view of a reveal substrate in accordance with an embodiment of the present invention.
Figure 3B:
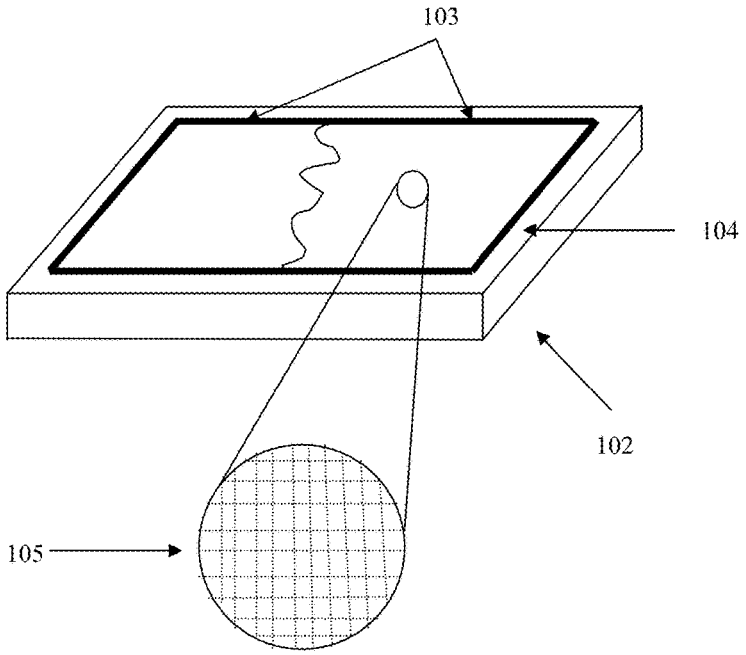
FIG. 3B shows a perspective view of the bottom substrate layer of a reveal substrate in accordance with an embodiment of the present invention.

In an embodiment of the present invention, each of the one or more colored areas comprise color blocks having colors of the CMYK color model, which is often used for printed color illustrations (see, e.g., FIG. 2). The CMYK color model is a subtractive color model which uses the colors cyan, magenta, yellow, and key (black). The CMYK color model is known to those having ordinary skill in the art, and discussed in detail in, e.g., Tkalcic et al. "Colour spaces, perceptual, historical and applicational background", University of Ljubljana, EUROCON 2003, pps 304-308; and Jennings, S. *Artist's Color Manual: The Complete Guide to Working with Color*. Chronicle Books LLC. (2003).

Figure 4A:
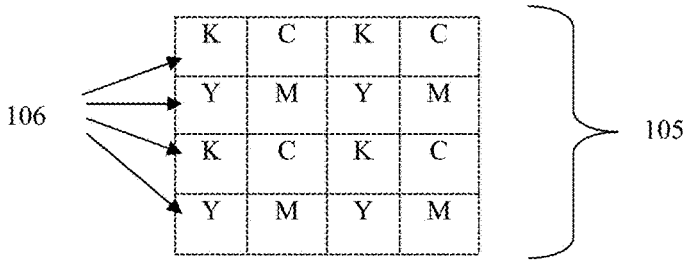
FIGS. 4A and 4B show examples of two-dimensional matrix formed by the plurality of color blocks in accordance with an embodiment of the present invention.
Figure 4B:
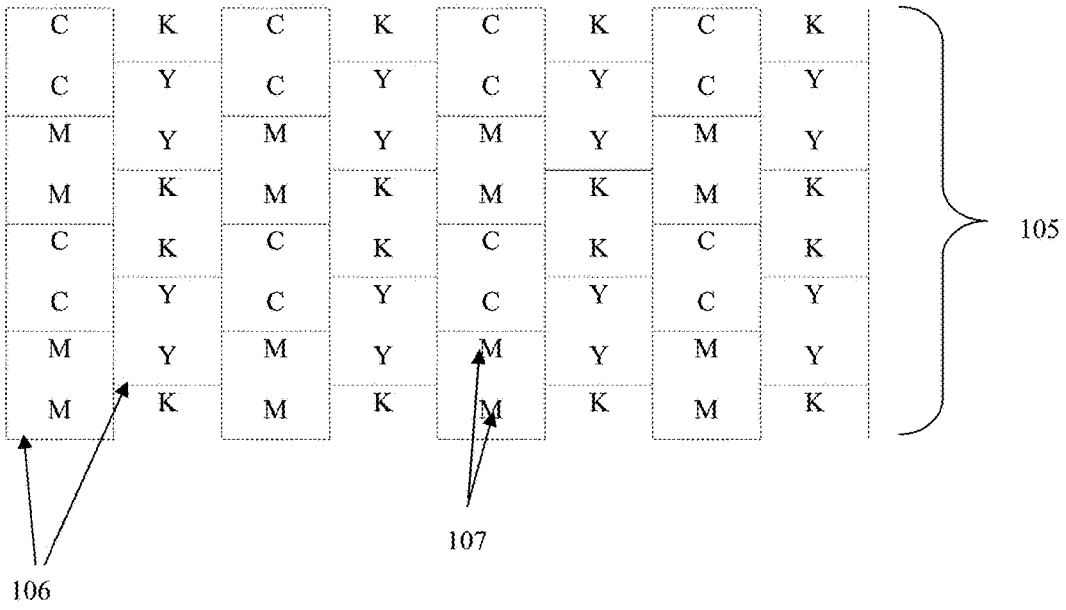

In an embodiment of the present invention, the arrangement of colors on the bottom substrate layer can be in the form of a grid. The squares of the grid can be lined up as shown in FIG. 4A or they can be off-set as shown in FIG. 4B. It should be clear to a person skilled the art that the dotted-lines of FIGS. 4A and 4B representing borders of the color blocks (106) would not be physically and visibly present on the bottom substrate layer (104).

In a further embodiment of the present invention, each of the plurality of color blocks comprises a plurality of print units (107), and all print units (107) within one color block (106) are of the same color. According to the present invention, each print unit represents the smallest distinct area which the print head can be programmed to apply heat or pressure. For example, FIG. 4B shows a two-dimensional matrix (105) having two print units (107), e.g., in the form of a color mark/dot, per color block (106). If the two-dimensional matrix (105) is a grid having a running bond pattern, there are ideally two or more mark/dots per square (as shown in FIG. 4B). It should be readily apparent that each capitalized letter "C", "M", "Y", "K" shown in FIGS. 4A and 4B represents a single print unit (107) of the colors cyan, magenta, yellow, and key (black), respectively. Although in other accompanying figures the print units are shown as squares or octagons, other geometric shapes are possible. In addition, the print units can be amorphous and/or have a shape resembling that of a splatter.

Providing the blocks of the grid in a running bond pattern (where borders of the blocks forming the grid are off-set) has the benefit of providing increased combinations of neighboring colors, thereby providing increased overall color and shading combinations available. Similarly, by including more than one print unit (107) per color block (106), it is possible to adjust the intensity and saturation of colors in the overall design by, e.g., revealing only one, two, or three or more of the print units in a single color block. In this manner, the design provides increased combinations of neighboring colors, thereby providing further increased overall color and shading combinations available.

Figure 5A:
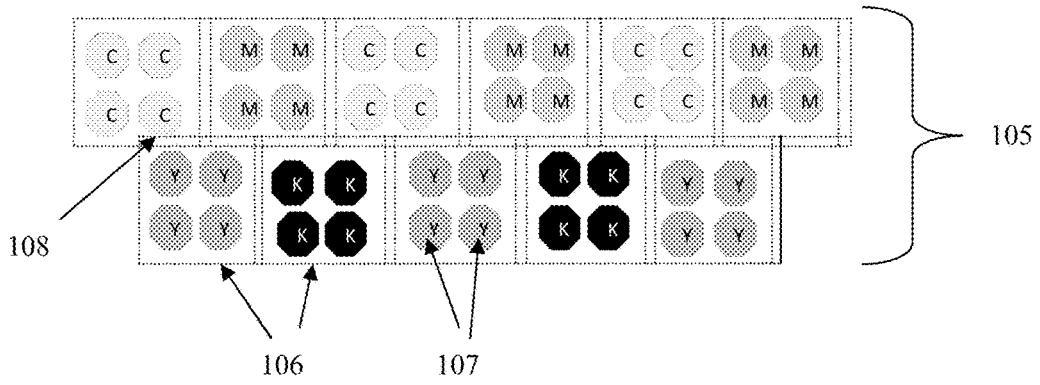
FIG. 5A shows a further example of a two-dimensional matrix formed by the plurality of color blocks in accordance with an embodiment of the present invention. In this two-dimensional matrix, the plurality of color blocks overlap, forming overlapped areas. Each capitalized letter "C", "M", "Y", "K" shown in FIG. 5A represents a single print unit of the colors Cyan, Magenta, Yellow, and Key (black) in the CMYK color model.
Figure 5B:
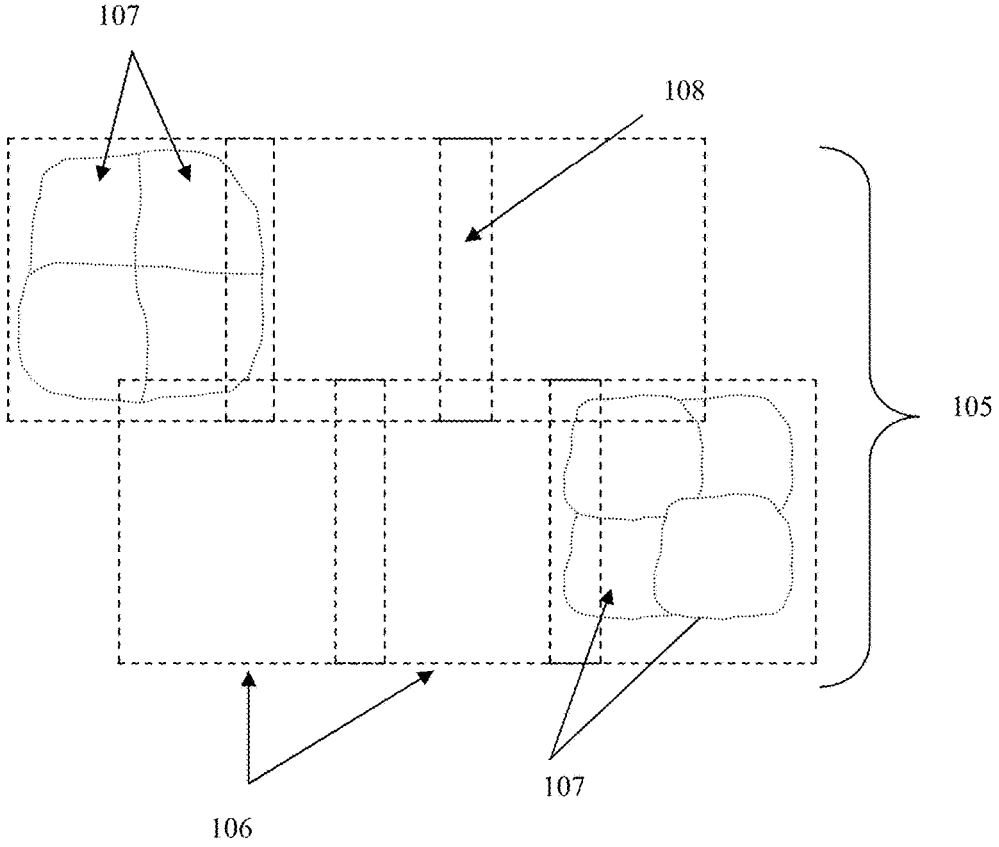
FIG. 5B shows yet a further example of a two-dimensional matrix formed by the plurality of color blocks in accordance with an embodiment of the present invention. In this two-dimensional matrix, print units are configured such that they either overlap with one or more adjacent print units, or share portions of their border with one or more adjacent print units. As a result, two or four print units within a single color block can combine to appear as a single colored area approximately two or four times the size of the individual print unit.
Figure 6:
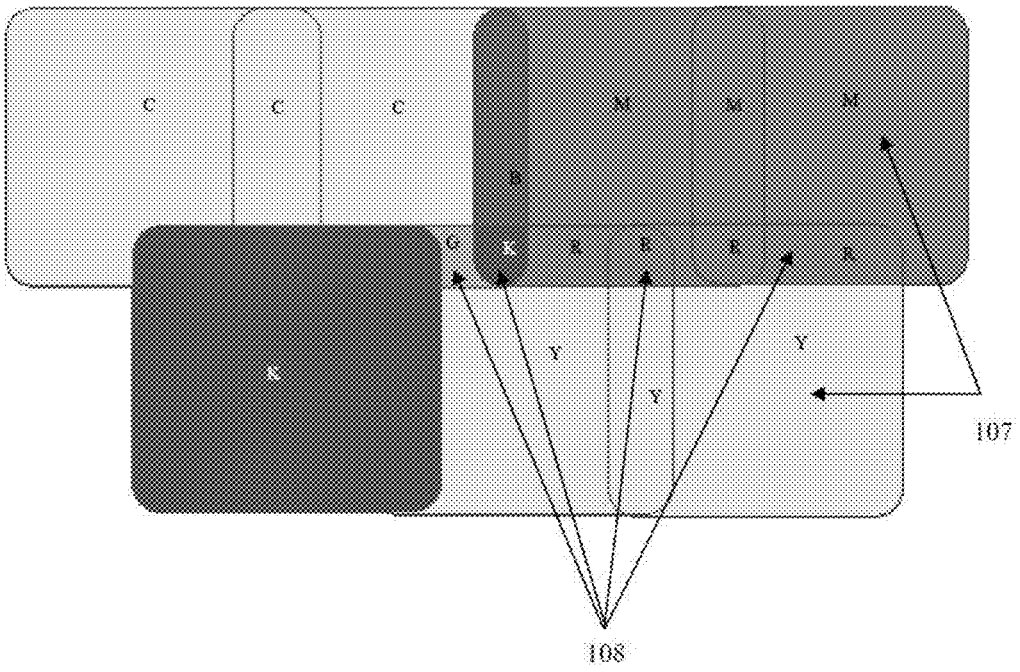
FIG. 6 shows a close-up view of adjacent print units and their area of overlap. Each capitalized letter "C", "M", "Y", "K" represents a single print unit of the colors Cyan, Magenta, Yellow, and Key (black) in the CMYK color model. The capitalized letters B, G and R represent, respectively, Blue, Green and Red.

In another embodiment of the present invention, the plurality of color blocks overlap, forming overlapped areas (108) which comprise a color formed from merging colors of the adjacent color blocks based on the appropriate color model used. In another embodiment of the present invention, each of the plurality of color blocks comprises a plurality of print units, and all print units within one color block are of the same color. These features are shown in FIGS. 5A and 5B. In FIG. 5A, the two-dimensional matrix (105) is a grid having a running bond pattern, wherein the color blocks (106) overlap, and each comprise 4 print units (107) having the same color. Although the 4 print units (107) as shown in FIG. 5A do not overlap with the overlapped areas (108) or neighboring print units (107), it should be understood that that area encompassed by the print units (107) and the overlapped areas (108) are not intended to be mutually exclusive. It can clearly be seen in FIG. 5B and FIG. 6 that the print units (107) can overlap. It should be clear to a person skilled the art that the dotted-lines and outlines of FIGS. 5A and 5B representing borders of the color blocks (106) would not be physically and visibly present on the bottom substrate layer (104).

Further it is not necessary to have print units (107) present as distinct areas. The above-described benefits can be achieved by providing within a color block a colored area that is two, three, four times or more of the size of the smallest print unit, then simply programming the print head to activate only portions thereof. In another word, multiple print units (107) can be provided within a color block which print units (107) lack distinct boundaries. Examples of such design can be seen in FIG. 5B.

In an embodiment of the present invention, the opaque polymer has a melting point of about 100-150° C. In another embodiment, the opaque polymer comprises styrene acrylic-copolymer. In another embodiment, the opaque polymer comprises a hollow sphere pigment (HSP) which appears opaque as a result of its light scattering properties.

In another embodiment of the present invention, the one or more colored areas are substantially coated on the bottom substrate layer. In another embodiment, said one or more colored areas extends substantially across the top surface of the bottom substrate layer. In another embodiment, the opaque polymer substantially covers each of the one or more colored areas. In another embodiment, the reveal substrate can comprise no adhesive, or comprise an adhesive material applied thereto. The adhesive material can be optionally pigmented. In another embodiment, said adhesive material is applied on a bottom surface of the bottom substrate layer, and/or on the top surface of the top substrate layer. In another embodiment, the adhesive material comprises an activatable adhesive. In another embodiment, the adhesive material comprises a pressure sensitive adhesive. In another embodiment, the reveal substrate comprises a release substrate having a mating surface applied over the bottom substrate layer and the pressure sensitive adhesive. In another embodiment, the release substrate is a paper based substrate.

The present invention further provides a method of thermal printing, which includes the steps of: (a) programing a printing device to apply heat or pressure to a section of the top substrate layer of the reveal substrate as described herein, said section of the top substrate layer corresponding in position to and obscuring selected color blocks or portions thereof present on the top surface of the bottom substrate layer, and (b) applying heat to the section of the top substrate layer to a predetermined temperature, or subjecting the section of the top substrate layer to a predetermined pressure, thereby causing the opaque polymer of said section of the top substrate layer to become transparent, and thereby revealing the selected color blocks or portions thereof, wherein the selected color blocks or portions thereof revealed in step (c) are sufficiently small such that a human being perceives an overall image formed by said selected color blocks or portions thereof.

Although the substrate and methods are described hereinabove with a focus on using heat and/or pressure to induce required color change in the material of the top substrate layer, additional means to induce said color change are envisioned and within the scope of the presently disclosed invention. Further, although the description focuses on revealing portions of the bottom substrate layer, an alternative embodiment wherein the top substrate layer comprises a transparent material which can be induced to become opaque, thereby selectively concealing portions of the bottom substrate layer, is envisioned and within the scope of the presently disclosed invention. Accordingly, in a separate embodiment, the top substrate layer as disclosed hereinabove alternatively comprises an opaque material which can be induced to become transparent, or a transparent material which can be induced to become opaque, by heat and/or pressure and/or other means, which include but are not limited to application of UV, chemicals, water, electrical current, etc.

Accordingly, in a separate embodiment, the reveal substrate alternatively comprises a) a top substrate layer comprising an opaque material which can be induced to become transparent, and b) a bottom substrate layer having one or more colored areas on a top surface thereof, said bottom substrate layer being disposed in a manner such that said one or more colored areas are obscured by the opaque material prior to being induced, and are revealed subsequent thereto, wherein: each of the one or more colored areas comprises at least two different colors, and each of the one or more colored areas comprises a two-dimensional matrix formed by a plurality of color blocks, each one of the plurality of color blocks having only one of the at least two different colors, and the plurality of color blocks are arranged to have a repeating color pattern, and the plurality of color blocks overlap, forming overlapped areas which comprise a color formed from merging adjacent colors. In yet another embodiment, a print substrate is provided comprising a) a top substrate layer comprising a transparent material which can be induced to become opaque, and b) a bottom substrate layer as described herein.

Examples of a material which is inducible by UV to change from being opaque to being transparent include white bleachable ink that may be laid down through thermal transfer or die sublimation. Further examples include SICURA CARD 110 N WA (71-010159-3-1180) (ANCIEN CODE 033250) from Siegwerk Druckfarben A G, Sieburg, Germany, Dye Diffusion Thermal Transfer (D2T2) inks available from Datacard Group of Minnetonka, Minn., USA or Dai Nippon Printing Co., Tokyo, Japan. Such materials may be altered selectively by exposing particular locations by a UV laser at a wavelength of, for example, 355 nanometers or 532 nanometers with an intensity in the range of 10 to 50 watts for a few milliseconds per addressable location. In an embodiment, the material of the top substrate layer can be changed from opaque to transparent by ink bleaching or evaporation.

Further, in an alternative embodiment the material of the top substrate layer may be amendable to a dry photographic process that requires no chemical picture treatment. One example is spiropyran photochrom with titanium oxide. This process is based on the photochemical behavior of colored complexes between spiropyrans and metal ions. A suitable alternative to SP2 401 is spiropyran indolinic (3',3'-dimethyl-1-isopropyl-8-methoxy-6-nitrospiro [2H-1-benzopyrane-2,2-indoline]).

In an alternative embodiment, the top substrate layer can be augmented with a doped organic semiconductor layer useful as an amplifier to improve the speed of transformation from opaque to transparent. Examples of materials for the doped organic semiconductor layer include polyvinyl carbazol and polythiophenes. A polyvinyl carabazol layer may be laid down by evaporation of 2.5 grams of polyvinyl carabazol in 50 cubic-centimeters of dichloromethane. The semiconductor layer is preferably doped to match the energy levels required for a photochromic effect in the top substrate layer. The photochromic effect of spiropyran-based top substrate layer may be achieved by exposure to visible or ultraviolet light. The preferred intensity is in the range of 50 to 200 watts at a distance of 30 to 300 millimeters for a duration of 10 to 300 seconds.

The present invention further provides a method which includes the steps of: (a) programming a printing device to induce the opaque material in a section of the top substrate layer of the reveal substrate of claim 1 to become transparent, said section of the top substrate layer corresponding in position to and obscuring selected color blocks or portions thereof present on the top surface of the bottom substrate layer, and (b) inducing the opaque material in the section of the top substrate layer to become transparent, and thereby revealing the selected color blocks or portions thereof, wherein the selected color blocks or portions thereof revealed in step (b) are sufficiently small such that a human being perceives an image formed by said selected color blocks or portions thereof. An analogous method comprising a step of inducing a transparent material in a section of the top substrate layer to become opaque, thereby concealing the selected color blocks or portions thereof, is also provided.

Specific embodiments and examples of the present invention described herein are to be understood as illustrative, and many variations can be introduced on these embodiments and examples without departing from the spirit of the disclosure or from the scope of the appended claims. Elements and/or features of different illustrative embodiments and/or examples may be combined with each other and/or substituted for each other within the scope of this disclosure and appended claims. The combination of any embodiment or feature mentioned herein with one or more of any of the other separately mentioned embodiments or features is contemplated to be within the scope of the instant invention.

What is claimed is:

1. A reveal substrate comprising:

a) a top substrate layer comprising an opaque material which can be induced to become transparent, and b) a bottom substrate layer having one or more colored areas on a top surface thereof, said bottom substrate layer being disposed in a manner such that said one or more colored areas are obscured by the opaque material prior to being induced, and are revealed subsequent thereto, wherein:

each of the one or more colored areas comprises at least two different colors, and each of the one or more colored areas comprises a two-dimensional matrix formed by a plurality of color blocks, each one of the plurality of color blocks having only one of the at least two different colors, and the plurality of color blocks are arranged to have a repeating color pattern, and the plurality of color blocks overlap, forming overlapped areas which comprise a color formed from merging adjacent colors.

2. The reveal substrate of claim 1, wherein the opaque material is photon-sensitive, and becomes transparent upon being exposed to UV at a predetermined wavelength and/or intensity.

3. The reveal substrate of claim 1, wherein each of the one or more colored areas comprise colors of the CMYK color model.

4. The reveal substrate of claim 1, wherein each of the plurality of color blocks comprises a plurality of print units, and all print units within one color block are of the same color.

5. The reveal substrate of claim 1, wherein said one or more colored areas are substantially coated on the bottom substrate layer.

6. The reveal substrate of claim 1, wherein said one or more colored areas extends substantially across the top surface of the bottom substrate layer.

7. The reveal substrate of claim 1, wherein the opaque material substantially covers each of the one or more colored areas.

8. The reveal substrate of claim 1, which comprises an adhesive material applied to the reveal substrate.

9. The reveal substrate of claim 8, wherein said adhesive is pigmented.

10. The reveal substrate of claim 8, wherein said adhesive material is applied on a bottom surface of the bottom substrate layer.

11. The reveal substrate of claim 8, wherein the adhesive material comprises a pressure sensitive adhesive.

12. The reveal substrate of claim 11, which comprises a release substrate having a mating surface applied over the bottom substrate layer and the pressure sensitive adhesive.

13. The reveal substrate of claim 12, wherein the release substrate is a paper based substrate.

14. The reveal substrate of claim 1, wherein the opaque material has a melting point of about 100-150° C.

15. The reveal substrate of claim 1, wherein the opaque material comprises styrene acrylic-copolymer.

16. The reveal substrate of claim 1, wherein the opaque material comprises a hollow sphere pigment (HSP) which appears opaque as a result of its light scattering properties.

17. A method of printing, which includes the steps of:

(a) programming a printing device to induce the opaque material in a section of the top substrate layer of the reveal substrate of claim 1 to become transparent, said section of the top substrate layer corresponding in position to and obscuring selected color blocks or portions thereof present on the top surface of the bottom substrate layer, and (b) inducing the opaque material in the section of the top substrate layer to become transparent, and thereby revealing the selected color blocks or portions thereof, wherein the selected color blocks or portions thereof revealed in step (b) are sufficiently small such that a human being perceives an image formed by said selected color blocks or portions thereof.

18. A method of thermal printing, which includes the steps of:

(a) programming a printing device to apply heat or pressure to a section of the top substrate layer of the reveal substrate of claim 1, said section of the top substrate layer corresponding in position to and obscuring selected color blocks or portions thereof present on the top surface of the bottom substrate layer, and (b) applying heat to the section of the top substrate layer to a predetermined temperature, or subjecting the section of the top substrate layer to a predetermined pressure, thereby causing the opaque polymer of said section of the top substrate layer to become transparent, and thereby revealing the selected color blocks or portions thereof, wherein the selected color blocks or portions thereof revealed in step (b) are sufficiently small such that a human being perceives an image formed by said selected color blocks or portions thereof.

* * * * *